US007118007B1

(12) United States Patent
Yates et al.

(10) Patent No.: US 7,118,007 B1
(45) Date of Patent: Oct. 10, 2006

(54) AUTOMATED MEDS DISPENSER SYSTEM

(75) Inventors: Cleon R. Yates, Austin, TX (US); Joe S. Guthrie, Elgin, TX (US)

(73) Assignee: CRY Twenty-Two, Inc., Austin, TX (US)

( * ) Notice: Subject to any disclaimer, the term of this patent is extended or adjusted under 35 U.S.C. 154(b) by 0 days.

(21) Appl. No.: 11/264,943

(22) Filed: Nov. 2, 2005

(51) Int. Cl.
*G07F 11/00* (2006.01)

(52) U.S. Cl. ..... 221/9; 221/309; 221/113; 221/133; 221/132

(58) Field of Classification Search ..... 221/113, 221/133, 152, 15, 2, 3, 9, 73, 82, 83, 132, 221/155, 252
See application file for complete search history.

(56) References Cited

U.S. PATENT DOCUMENTS 5,097,982 A * 3/1992 Kedem et al. ..... 221/8
RE36,341 E * 10/1999 Howell ..... 221/82
6,021,918 A * 2/2000 Dumont et al. ..... 221/9

* cited by examiner

*Primary Examiner*—Gene O. Crawford
*Assistant Examiner*—Timothy Waggoner
(74) *Attorney, Agent, or Firm*—Hugh D. Jaeger, Esq.

(57) ABSTRACT

An automated Meds dispenser system including a staging station for systematic loading of Meds into vials and an automated Meds dispenser for receiving and for subsequent distribution of Meds containing vials at multiple times over a period of multiple days. User friendly on-board circuitry and controls are provided to set the desired Meds distribution times. A positionable indexer plate accommodates the vials containing Meds which are loaded by the user or health care professional and subsequently distributed and presented by the automated Meds dispenser on a timely basis one vial at a time for use by a patient. The positionable indexer plate is advanced one position at a time as specified and stored in an onboard programmable microprocessor.

14 Claims, 5 Drawing Sheets

AUTOMATED MEDS DISPENSER SYSTEM

CROSS REFERENCES TO RELATED APPLICATIONS

None.

BACKGROUND OF THE INVENTION

1. Field of the Invention

The present invention pertains to the medical field, and more particularly, pertains to an automated Meds dispenser system where an automated Meds dispenser programmed by a user or health care professional presents medicines in pill or capsule form for use at designated time intervals.

2. Description of the Prior Art

Prior art pill or capsule dispensers include units incorporating one or more rotatable "permanent chambers" of varying size and shape in which Meds, an abbreviation commonly used for medications, are stored while waiting to be dispensed. Meds, when placed in these rotatable "permanent chamber" models, fall naturally with the aid of gravity to the floor of the rotatable chamber. The chamber floor, however, is a separate stationary plate/disc with a hole at one location, thereby allowing the Meds to pass through the hole when the rotatable chamber passes over the chamber floor. As the rotatable chamber rotates and advances according to the next programmed time period, the Meds are "dragged" along on the flat stationary floor bottom of the rotatable chamber until they reach the opening and drop down through a slot ready for use. This sliding and grinding action between the Meds in the rotatable chamber and the stationary floor can lead to foreign particles being picked up, which could bring about contamination, thereby causing serious illness or reducing the effectiveness of the medications. Further, after these "permanent chamber" models have been used and reloading occurs, with possibly different medications, cross-contamination could occur because of residue, granules or particles left over from previous use. This circumstance could possibly cause allergic reactions in some instances or other complications.

Prior art Meds dispensation units are complicated, cumbersome and impractical and do not address all the safety concerns required when administering medications in this fashion.

Methodology for the interruption of a programmed cycle of prior art devices in order to add or delete Meds should the need arise are not prevalent, nor are any specific ways of removing Meds should the system fail or break down.

Previous devices do not address power failure and its effect on an ongoing programmed schedule.

What is needed is an automated Meds dispenser system which overcomes the deficiencies of the prior art devices.

SUMMARY OF THE INVENTION

The general purpose of the present invention is to provide an automated Meds dispenser system which dispenses Meds on a timely basis. The automated Meds dispenser system, the present invention, includes an automated Meds dispenser and a staging station. Meds, such as pills and capsules, are distributed by the user or a health care professional into a plurality of vials systematically contained and arranged in a staging station having a matrix which is marked by days of the week and by Meds designation or by other such convenient markings. Vials containing the Meds are transferred from the staging station to the automated Meds dispenser for timed and systematic presentation one vial at a time by the automated Meds dispenser from which the vial is manually removed and the Meds consumed. A control panel is provided including a clock, a key operated multiple position switch, an audible warning device, verification lights, and various control buttons used for control of a microprocessor and of the mechanical functions of the automated Meds dispenser. A key can be used by a health care professional or by the user to prevent unauthorized access to or tampering with the automated Meds dispenser. An enclosure consists of a readily detached cover secured to a base, the combination of which houses the mechanical components of the automated Meds dispenser. Central to the enclosure is a pivoted round indexer plate in which a plurality of removable vials are held. An electric motor is incorporated to rotate the indexer plate to deliver one of a plurality of vials containing Meds to a delivery port located at the front of the enclosure. Optical sensor switches are incorporated to sense the indexer plate position and a solenoid is incorporated to prevent manual manipulation of the indexer plate to obtain Meds before the prescribed time. The program and thus the movement of the indexer plate can be interrupted to either add or remove Meds if desired, followed by the return of the indexer plate to a previous position without interrupting a scheduled program. A new schedule can be started before a predetermined schedule has been completed. A power failure feature is also included to deliver the Meds at the proper time and, in addition, the cover of the enclosure is readily detached from the base of the enclosure should a power failure occur and access to the Meds be required.

According to one aspect of the present invention, there is provided an automated Meds dispenser, part of the automated Meds dispenser system, including a base having multiple support mounts extending vertically therefrom, a cover including a control panel with control buttons and having a clock display and other control buttons and related features including a microprocessor, a rotatable and positionable indexer plate, a Meds delivery port at the front edge of the cover, a plurality of Meds delivery vials, a pivotable motor plate for mounting of a positionable electric motor where the rotatable motor plate is supported by support mounts extending vertically from the base, a plurality of vial orifices arranged in circular form near the outer edge of the indexer plate, a plurality of indexer orifices arranged in circular form and toward the center from the vial orifices, a single indexer orifice located inwardly from the plurality of indexer orifices, a supported pivot pin about which the indexer plate is rotated, a timing belt between a sprocket located at the top of the electric motor and a sprocket on the indexer plate incorporated to drive the indexer plate by actuation of the electric motor, an optical sensor switch aligned to the circular arrangement of indexer orifices, an optical sensor switch incorporated to sense the single indexer orifice, and a supported solenoid aligned to the plurality of indexer orifices.

According to another aspect of the present invention, a substantially two-part staging station, being part of the automated Meds delivery system, is provided. The two-part staging station comprises a box-like structure with an upwardly located panel including a plurality of holes for accommodation of Meds vials and a cover which containingly fits over and about the sides of the box-like structure. The cover top engages the openings of the vials to prevent escape of the Meds from the vials.

One significant aspect and feature of the present invention is an automated Meds dispenser system including a staging station and an automated Meds dispenser.

Another significant aspect and feature of the present invention is a staging system having vials springingly forced upwardly against a staging station cover to ensure containment of Meds within the vials.

An additional significant aspect and feature of the present invention is an automated Meds dispenser system which is operated in a straightforward method by a user or health care professional.

Another significant aspect and feature of the present invention is an automated Meds dispenser system which is programmable to deliver Meds in separate vials at different times during treatment with Meds.

Still another significant aspect and feature of the present invention is an automated Meds dispenser system in which the Meds are contained in vials.

Still another significant aspect and feature of the present invention is an automated Meds dispenser system in which the Meds are not subject to dragging about the bottom of a rotatable chamber.

A further significant aspect and feature of the present invention is an automated Meds dispenser system which can be programmed to deliver Meds at different times over a period of days.

A further significant aspect and feature of the present invention is an automated Meds dispenser system which cannot be manually advanced for Meds access ahead of time.

A further significant aspect and feature of the present invention is an automated Meds dispenser system having an audible tone and a verification light for notification of delivered Meds.

A further significant aspect and feature of the present invention is an automated Meds dispenser system the program of which is interruptable to add or delete Meds and wherein the automated Meds dispenser returns to the position at which the interruption was created.

Still a further significant aspect and feature of the present invention is an automated Meds dispenser system wherein a cycle period can be interrupted and a new cycle period started when required.

Yet a further significant aspect and feature of the present invention is an automated Meds dispenser system incorporating a backup battery to allow clock operation for accurate delivery of Meds once power is restored.

Another significant aspect and feature of the present invention is an automated Meds dispenser system in which the enclosure can be readily dismantled to gain access to the Meds in case of a power failure.

Having thus described an embodiment of the present invention and enumerated various significant aspects and features thereof, it is the principal object of the present invention to provide an automated Meds dispenser system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
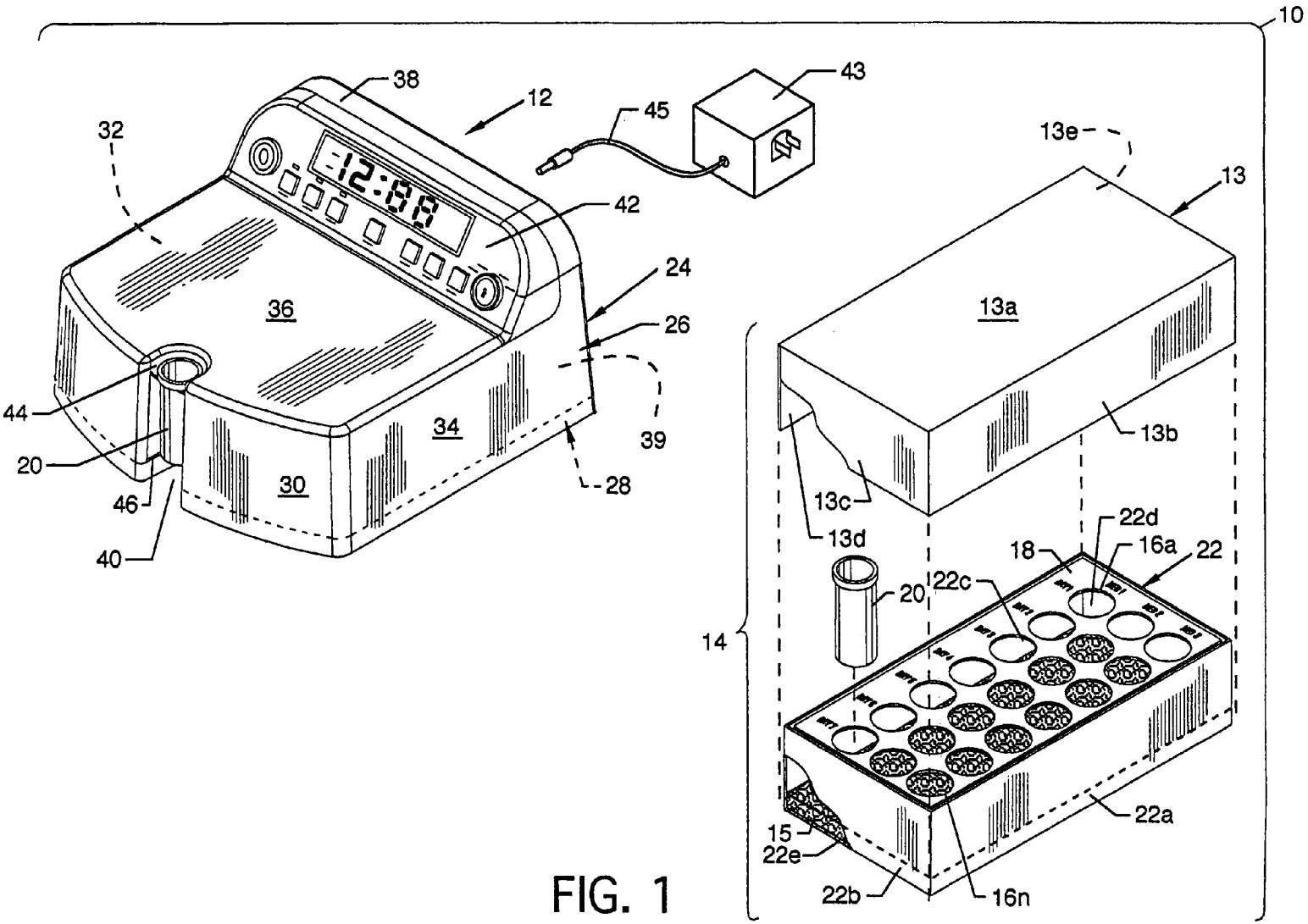
FIG. 1 illustrates an isometric view of the automated Meds dispenser system, the present invention.

FIG. 1 is an isometric view of the automated Meds dispenser system 10, including an automated Meds dispenser 12 and a staging station 14. The staging station 14 includes a box 22 and a cover 13. The upper region of the box 22 includes a panel 18 having a matrix of holes 16*a*–16*n* extending therethrough for accommodation of a plurality of like vials 20, such as shown at the front edge of the automated Meds dispenser 12 and as shown in alignment with one of the holes 16*a*–16*n*. The holes 16*a*–16*n* in the matrix are identified by labels such as, but not limited to, MED 1 through MED 3 along one edge of the panel 18 and by the days of the week along an intersecting edge, and can be round or of other desired and other suitable shapes as required. The panel 18 is supported by other structure of the box 22 including four sides 22*a*, 22*b*, 22*c* and 22*d* and a bottom 22*e*. The cover 13 can be an open bottom box-like structure having a top 13*a* and sides 13*b*, 13*c*, 13*d* and 13*e* where the sides snugly, firmly or snappingly engage or otherwise secure to the perimeter of the sides 22*a*, 22*b*, 22*c* and 22*d* of the box 22 to suitably engage the cover 13 to the box 22 to position the top 13*a* of the cover 13 against residing vials 20 held in the panel 18 for Meds containment during storage or transportation of the staging station 14. Additionally, a layer of compressible material 15 such as, but not limited to, foam, sponge rubber, and the like can be suitably located in direct communication with the box bottom 22*e* in the lower and inner region of the box 22 to springingly engage the lower region of vials 20 residing in the holes 16*a*–16*n* to assure containment of the Meds within the vials 20 during storage or transportation of the staging station 14. The compressible material 15 is of sufficient thickness and exhibits sufficient spring-like qualities to urge the vials 20 residing in the holes 16*a*–16*n* upwardly against the cover top 13*a* to cause the open tops of the vials 20 to sealingly engage the cover top 13*a*, thereby ensuring containment of the Meds in each of the vials 20. The compressible material 15 is of sufficient thickness and exhibits sufficient spring-like qualities to allow proper engagement of the cover top 13*a* against the tops of the vials 20 while still maintaining suitable snug, firm or snap engagement of the cover 13 with the perimeter of the box sides 22*a*, 22*b*, 22*c* and 22*d*. In the alternative, a hinge can also be suitably disposed between the cover 13 and the box 22 for convenience or to preclude misplacement of the cover 13 or the box 22.

Visible components of the automated Meds dispenser 12 include an enclosure 24 having a cover 26 which fits over and which can be readily detached from a base 28. The cover 26 includes a front panel 30, side panels 32 and 34, a top panel 36, an elevated panel 38 extending upwardly from the rearward region of the side panels 32 and 34, and a rear panel 39 extending between the rearward region of the side panels 32 and 34 and intersecting the elevated panel 38. A Meds delivery port 40 is located central to the front panel 30 extending vertically through the forward portion of the top panel 36 at the front edge of the cover 26 for presentation of the vials 20 containing Meds for consumption by the user. A control panel 42 aligns at an angle to the top panel 36 and extends upwardly to intersect the elevated panel 38. A power supply 43, such as a wall-mounted power supply, and a power delivery cord 45 are provided to deliver 12-volt DC power or other suitable current to the automated Meds dispenser 12.

Figure 2:
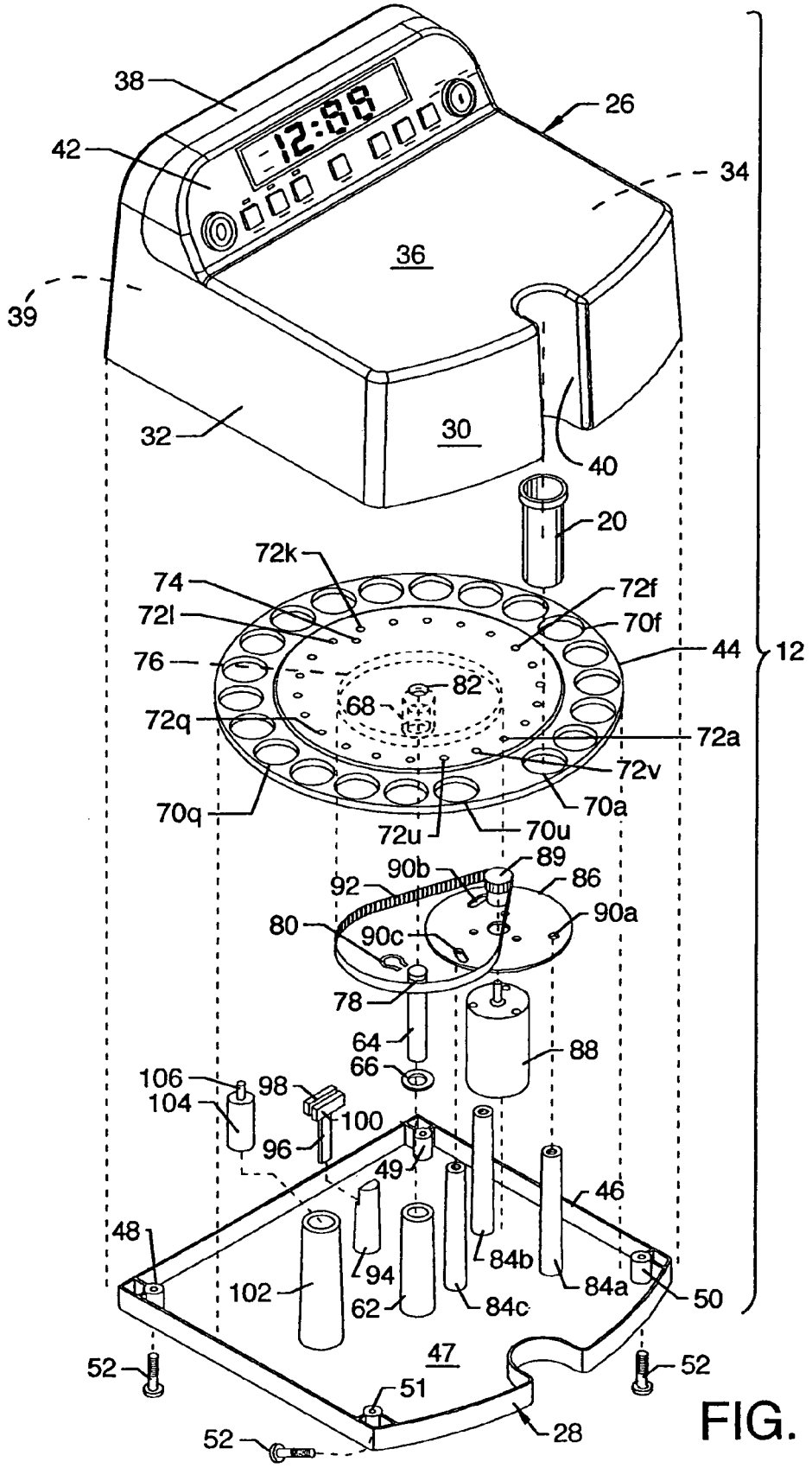
FIG. 2 is an exploded isometric view of the automated Meds dispenser.
Figure 3:
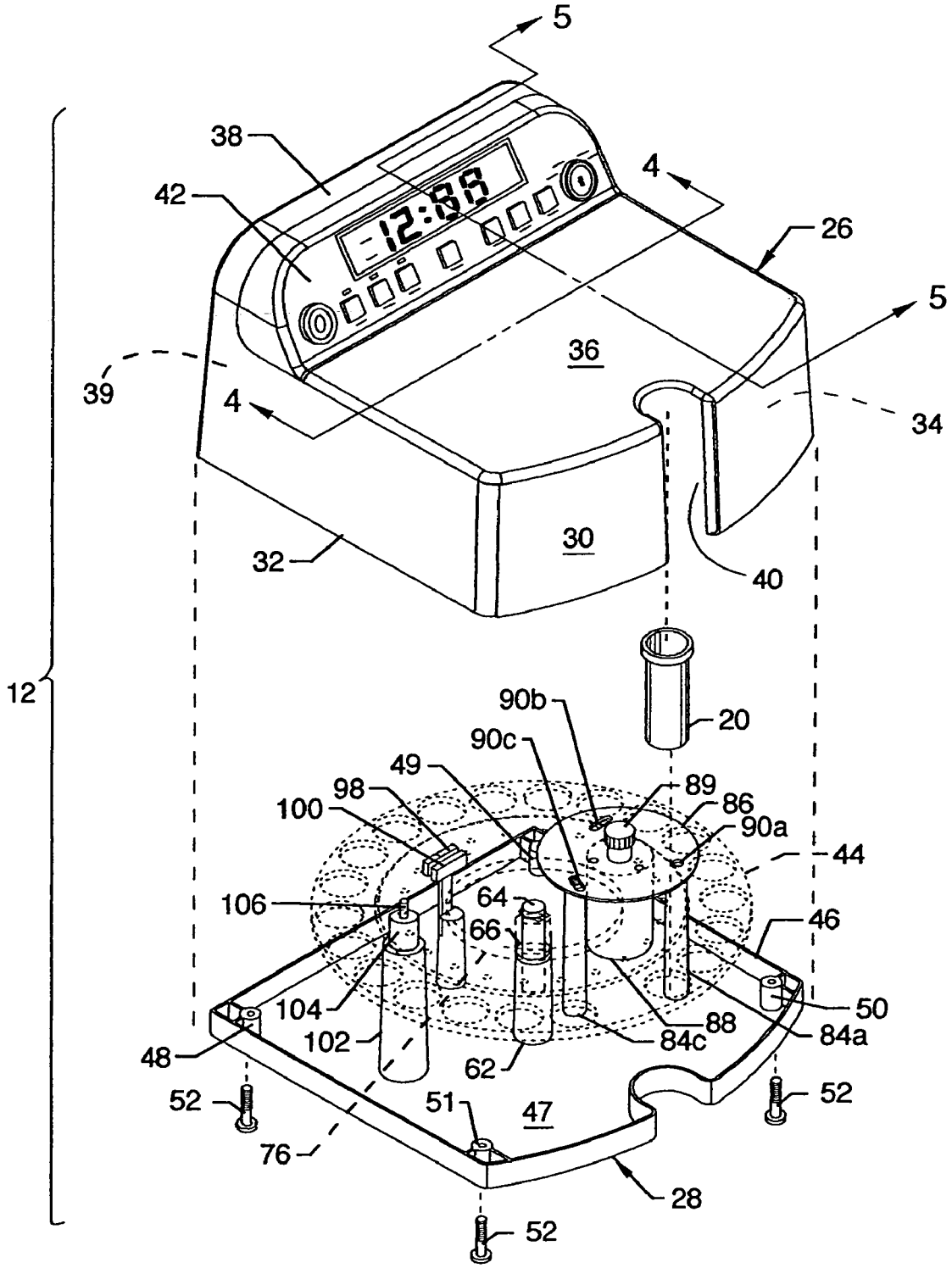
FIG. 3 illustrates the cover of the automated Meds dispenser removed from the base of the automated Meds dispenser with some parts shown in dashed lines and others omitted for clarity.

FIG. 2 is an exploded isometric view of the automated Meds dispenser 12, and FIG. 3 illustrates the cover 26 removed from the base 28 with some internal components omitted for clarity and with the indexer plate 44 and other components shown in dashed lines. The base 28 includes a continuous lip 46 extending upwardly from bottom planar panel 47 of the base 28. The rearwardly and forwardly located corner regions near the continuous lip 46 include vertically extending mating pads 48, 49, 50 and 51 having body holes extending vertically therein where screw fasteners 52 are accommodated to fasten the base 28 to the cover 26. A plurality of corresponding mating pads, of which 53 and 55 are shown in various figures, are located at the lower and inwardly facing corner regions of the cover 26 into which the screw fasteners 52 secure to fasten the base 28 to the cover 26. A plurality of support mounts having open hardware accommodating tops extend upwardly from the bottom planar panel 47 of the base 28. A centrally located indexer plate support mount 62 provides support for the indexer plate 44 via a pivot pin 64 accommodated in the top portion thereof. The center of a Delrin® washer 66 acting as a thrust bearing is accommodated by the pivot pin 64. The Delrine® washer 66 aligns between the upper annular surface of the indexer plate support mount 62 and the lower annular surface of a tubular body 68 which extends downwardly from the central region of the indexer plate 44. The indexer plate 44 includes a plurality of vial orifices 70*a*–70*u* near the outer periphery of the indexer plate 44 for accommodation of vials 20. While the vial orifices 70*a*–70*u* are shown as being round, any convenient and suitable other shape may be used; and material such as, but not limited to, glass, plastic, metal, or ceramic, may be incorporated as required to accommodate the various shapes or styles of vials 20. The vial orifices 70*a*–70*u* are distributed and spaced equally along and about an imaginary circle near the periphery of the indexer plate 44 with the exception of the spacing between vial orifices 70*a* and 70*u* called HOME, where such a space occupies substantially the same area and region, such as if another vial orifice were present. In other words, vial orifices 70*a*–70*u* are to be perceived as spaced for twenty-two orifices, but the twenty-second orifice was omitted, its place being taken by the HOME position. The HOME position is that position where no access or orifice to place a vial 20 is provided. A plurality of smaller indexer orifices 72*a*–72*v* align about an imaginary circle being located inwardly from the vial orifices 70*a*–70*u*. The indexer orifices 72*a*–72*v* communicate with both an optical sensor switch 98 and a solenoid 104 offset from the position of the optical sensor switch 98, as later described in detail. An additional single indexer orifice 74 associated with the HOME position is located inwardly toward the center of the indexer plate 28, as well as inward from indexer orifices 72*k* and 721. A sprocket 76 is located extending downwardly from the underside of the indexer plate 44. The tubular body 68 also extends downwardly from the sprocket 76 to accommodate the upper part of the pivot pin 64. The upper part of the pivot pin 64 includes a groove 78 which accommodates a snap ring 80. The upper region of the pivot pin 64 extends through a centrally located pivot hole 82 in the indexer plate 44 and is secured thereupon by the engagement of the snap ring 80 with the groove 78 at the upper portion of the pivot pin 64. Similar motor plate support mounts 84*a*–84*c* extend vertically from the bottom planar panel 47 of the base 28 to support a pivotable motor plate 86 to which a motor 88 having a sprocket 89 suitably secures. Located near the periphery of the motor plate 86 are a round hole 90*a* and elongated holes 90*b* and 90*c*, each of which aligns and suitably secures to the threaded tops of the motor plate support mounts 84*a*, 84*b* and 84*c*, respectively. The entire motor plate 86 pivots about the round hole 90*a* and a fastener in the motor plate support mount 84*a* to allow the arrangement and relationship of the elongated holes 90*b* and 90*c* to be utilized, with fasteners, to position the attached motor 88 for tightening of a timing belt 92 extending between the motor-mounted sprocket 89 and the sprocket 76 on the lower region of the indexer plate 44. An optical sensor switch support mount 94 extends vertically from the bottom planar panel 47 of the base 28 to support an optical sensor switch support 96 having upwardly looking optical sensor switches 98 and 100 where, with respect to the center of the indexer plate 44, the optical sensor switch 98 is located outwardly from the optical sensor switch 100. The optical sensor switch 98 aligns to the radius described by the movement of the circularly arranged indexer orifices 72*a*–72*v* to sense alignment with successively positioned indexer orifices 72*a*–72*v* on an individual basis; and the optical sensor switch sensor 100 aligns to the radius described by the imaginary circle described by movement of the single indexer orifice 74 to sense alignment with the single indexer orifice 74. A solenoid support mount 102 extends vertically from the bottom planar panel 47 of the base 28 to support the solenoid 104. The actuator shaft 106 of solenoid 104 aligns to the radius described by the circularly arranged indexer orifices 72*a*–72*v*.

Figure 4:
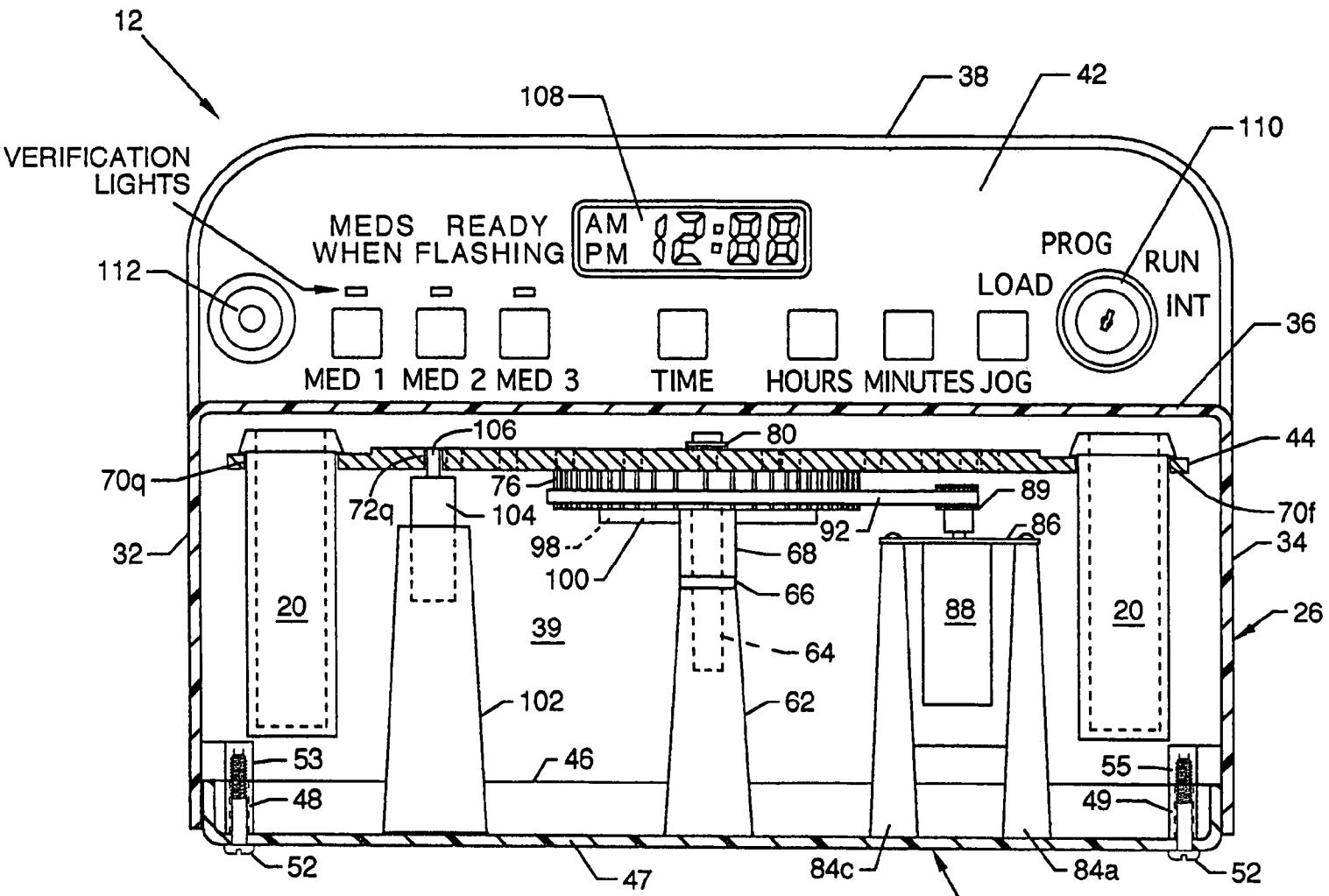
FIG. 4 illustrates a cross section view of the automated Meds dispenser along line 4—4 of FIG. 3 showing the mechanisms contained therein as well as the features and labels included on the control panel; and, FIG. 5 illustrates a partial cross section view of the automated Meds dispenser generally along line 5—5 of FIG. 3 showing the mechanisms contained therein as well as the features included on the control panel.

FIG. 4 is a cross section view of the automated Meds dispenser 12 along line 4—4 of FIG. 3 showing the mechanisms contained therein as well as the features and labels included on the control panel 42. Shown in detail is the indexer plate 44 and a majority of the components associated with the operation of the indexer plate 44. As previously described, the timing belt 92 connects the sprocket 89 driven by motor 88 to the sprocket 76 at the lower portion of the indexer plate 44 to rotatably position the indexer plate 44 through a plurality of positions, (22 positions for purposes of example and illustration). The solenoid actuator shaft 106 of the solenoid 104 is normally extended to engage one of the indexer orifices 72*a*–72*v*, and in this example is shown engaging indexer orifice 72*q* to fix the indexer plate 44 in a non-rotational status position. Operation of the solenoid 104 is required just prior and during advancement of the indexer plate 44 about the pivot pin 64 in order to retract the solenoid actuator shaft 106 from engagement with the indexer orifices 72*a*–72*v* for the purpose of allowing rotation of the indexer plate 44 for Meds delivery. The engagement of the mating pads 48 and 49 of the base 28 with the mating pads 53 and 55, respectively, of the cover 26 is also shown.

The features and labels included on the control panel 42 include a centrally located clock having a clock display 108; a multiple position key switch 110 having labels indicating a LOAD position, a PROG position (program), a RUN position and an INT position (interrupt); and control buttons MED 1, MED 2 and MED 3, each having a corresponding verification light placed above the control buttons herein called, but not labeled, the MED 1 verification light, the MED 2 verification light, and the MED 3 verification light. A label entitled MEDS READY WHEN FLASHING is located over the control buttons MED 1, MED 2 and MED 3 and corresponding MED 1, MED 2 and MED 3 verification lights. A TIME control button, an HOURS control button, a MINUTES control button, and a JOG control button are also included. An audible warning device 112, such as a piezoelectric or other suitable device, is also included on the control panel 42.

Figure 5:
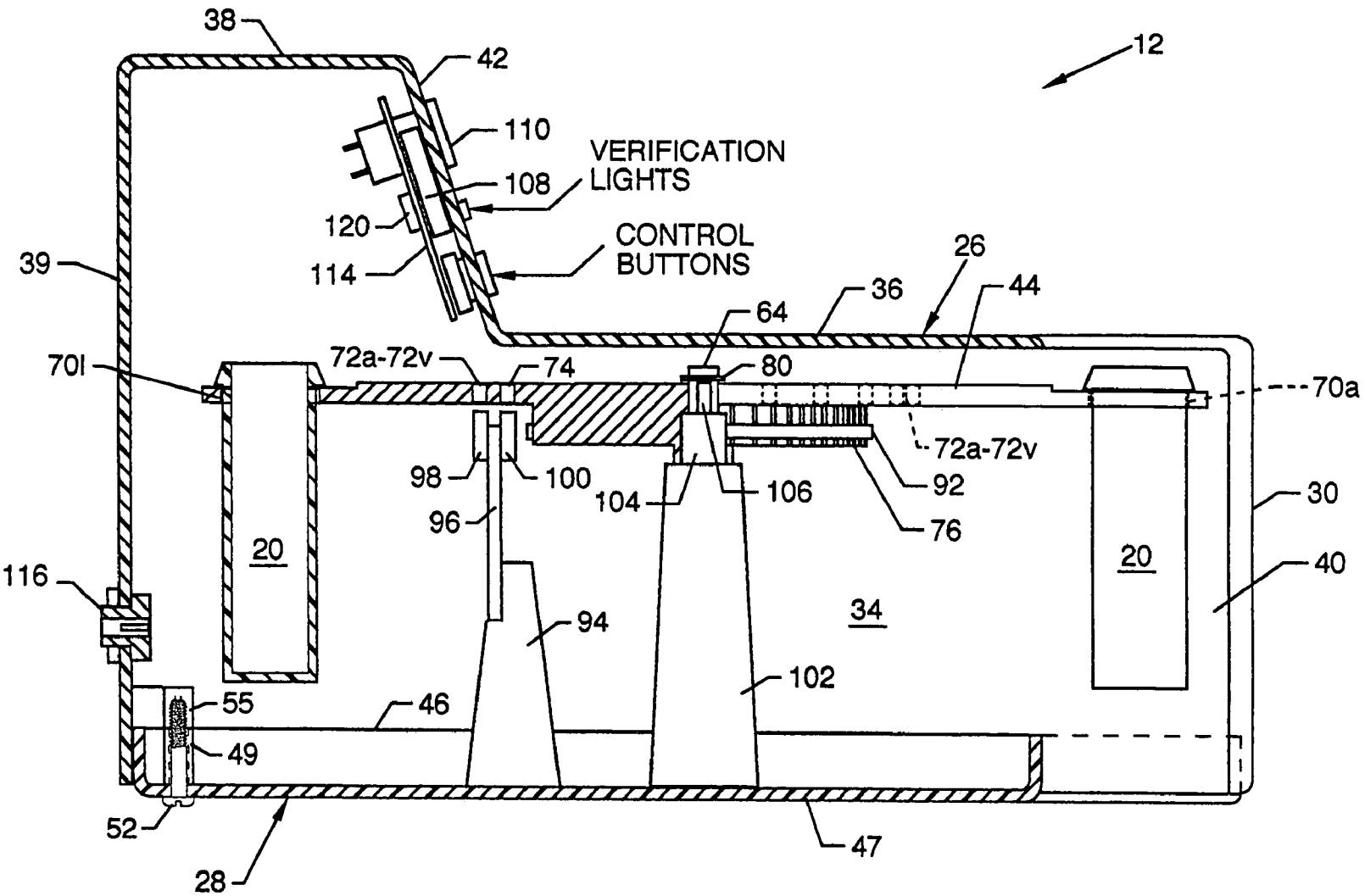

FIG. 5 illustrates a partial cross section view of the automated Meds dispenser 12 generally along line 5—5 of FIG. 3 showing the mechanisms contained therein as well as the features included on the control panel 42. Illustrated in particular is the optical sensor switch 98 in alignment with the radius described by the movement of the circularly arranged indexer orifices 72*a*–72*v* and the optical sensor switch sensor 100 aligned to the radius described by the imaginary circle described by movement of the single indexer orifice 74. The optical sensor switch 98 senses proximity of the indexer orifices 72*a*–72*v* to coordinate and index movement of the indexer plate 44 at timed intervals of Meds delivery, whereby a vial 20 containing Meds is advanced into the Meds delivery port 40 for Meds dispensing. The optical sensor switch 100 senses alignment with the single indexer orifice 74 (HOME) for use to subsequently return the indexer plate 44 to the LOAD position. Also shown is a screw fastener 52 extending through the mating pad 49 of the base 28 into the mating pad 55 of the cover 26 to assist in securing the cover 26 to the base 28. The screw fasteners 52 can be quickly removed and the cover 26 removed from the base 28 to gain quick access to the interior of the automated Meds dispenser 12, if required. Such cause for removal could be for recouping of Meds which escaped from the vials 20 where the automated Meds dispenser 12 was oriented in such a way as to cause such Meds to leave the confines of the vials 20. In the alternative, the indexer plate 44 can be spaced in close proximity to the top panel 36 of the cover 26 to ensure containment of Meds in the vials 20.

Also shown is a programmable computer in the form of a microprocessor 114 containing circuitry for the operation of the automated Meds dispenser 12, and an electrical jack 116 incorporated for delivery of 12-volt DC power or other suitable electrical power of required voltage, such as provided by the power supply 43 and the power delivery cord 45. A backup battery 120 is provided to continue operation of the clock circuits provided by the microprocessor 114. The motor 88, the motor plate support mounts 84*a*–84*c*, and the motor plate 86 are not shown for the purpose of brevity and clarity.

MODE OF OPERATION

The automated Meds dispenser system can be easily programmed to provide Meds three times daily, any time of the day or night, for a period of seven days or, if constructed according to the teachings of the present invention to provide more capacities, can deliver Meds at an increased timed frequency for an increased number of days. Operation of the automated Meds dispenser system 10 is best understood by perusing an example of programming, loading and usage instructions which additionally include reference numerals enclosed in parenthesis, labels, and reference to other control panels items.

Programming, Loading and Usage Instructions

1. Attach the power supply (43) to a 110V AC power source. Connect the power delivery cord (45) to the jack (116) at the rear of the automated Meds dispenser (12).

2. Place a key into the multiple position key switch (110) and position the multiple position key switch (110) to PROG position (program).

3. Set the current time of day using the HOURS and MINUTES control buttons and press TIME.

4. Set first Meds delivery time using the HOURS and MINUTES control buttons and press MED 1.

5. Set second Meds delivery time using the HOURS and MINUTES control buttons and press MED 2.

6. Set third Meds delivery time using the HOURS and MINUTES control buttons and press MED 3.

Note: Programming is now complete. Turn the key to position the multiple position key switch (110) to the LOAD position, and indexer plate (44) automatically returns to the HOME location where vials (20) cannot yet be loaded.

7. Press JOG and the indexer plate (44) advances to the MED 1 location. Then manually place a first vial (20) containing Meds into the vial orifice (70*a*). The green verification light above the MED 1 control button is illuminated.

8. Press JOG and the indexer plate (44) advances to the MED 2 location. Then manually place a second vial (20) containing Meds into the vial orifice (70*b*). The green verification light above the MED 2 control button is illuminated.

9. Press JOG and the indexer plate (44) advances to the MED 3 location. Then manually place a third vial (20) containing Meds into the vial orifice (70*c*). The green verification light above the MED 3 control button is illuminated.

Note: Continue to press JOG until all vials containing Meds are placed into the remaining vial orifices (70*d*–70*u*). (Maximum: 3 Meds in a 24-hour period for 7 days.)

10. The PROG and LOAD sequences are now complete. Turn the key to position the multiple position key switch (110) to the RUN position and wait for scheduled MEDS times to occur.

How to Interrupt an Ongoing Schedule to Make Changes to Medications

Should the need arise to interrupt an ongoing programmed schedule in order to make additions or deletions to the remaining Meds in the current program, the following procedure should be followed.

Turn the key to position the multiple position key switch (110) to INTER (interrupt) position, press JOG and the next scheduled Meds will appear. Make changes to Meds as required and continue to press JOG and make changes until all required changes are completed. Now turn the key to position the multiple position key switch (110) to the RUN position and the indexer plate (44) will automatically return to the previous location, that location being the point of interruption, and ready for the next scheduled MEDS time.

How to Refill Indexer Before Weekly Schedule Has Expired

Should an individual desire to begin a new 7-day cycle period a few days before the current cycle has expired, turn the key to position the multiple position key switch (110) to the LOAD position and the indexer plate (44) will automatically return to the HOME location. Follow and repeat steps 7, 8 and 9 until all Meds are replaced. Now turn the key to position the multiple position key switch 110 to the RUN position and a new 7 day cycle will begin. Wait for scheduled MEDS times to occur. (End Programming, Loading and Usage Instructions).

Operation of the automated Meds dispenser system 10 is initiated by loading of vials 20 into the holes 16*a*–16*n* in the staging station 14 and then placing Meds into the appropriate vials 20 according to the required usage, times and days of the week. In the alternative, the vials 20 could be filled first and then loaded into the staging station 14. Vials 20 of the staging station 14 can be filled in advance of anticipated usage where the cover 13 is utilized to seal the Meds within the vials 20. Such usage of the cover 13 also prepares the staging station 14 for storage or transportation with Meds contained in vials. Although the vials 20 are open to receive Meds, the vials 20 could be filled and appropriately sealed, such as by foil or other suitable sealing devices, at a pharmacy, pharmaceutical company or other offsite location where the vials are appropriately sealed in a sterile location. The staging station 14 is portable and can be returned to a pharmacist for filling of prescriptions. Once the medications have been sorted and placed into the vials and located in the staging station, the vials 20 are then transplanted into the automated Meds dispenser. The vials 20 are very inexpensive and it would be conceivable to replace old vials 20 with new ones should one change medication; however, the vials 20 can be reused as they are designed to be placed back into the staging station 14 as usage occurs. Using this visual method, a user can also tell, at a glance, how many vials 20 have been returned to the staging station 14 and thereby easily determine how many days remain before it will again be necessary to reload the vials 20 of the staging station 14.

Operation of the invention continues according to the previously given instructions. Loading is accomplished by turning the key to position the multiple position key switch 110 to the LOAD position causing the motor 88 to revolve the indexer plate 44 until the indexer orifice 74 is sensed by the optical sensor switch 100, thereby rotationally positioning the indexer plate 44 to the HOME position. The JOG control button is then pressed multiple times to advance the indexer plate 44 for loading of vials 20 one at a time. After loading, the multiple position key switch 110 is turned to the RUN position. When the programmed Meds delivery times occur, the microprocessor 114 commands operation of the mechanical structures including the solenoid 104 and the motor 88. When a programmed Meds time occurs, the microprocessor 114 sends a signal to activate the solenoid 104 for an appropriate pulsed time interval, thereby retracting the solenoid actuator shaft 106 to allow rotation of the indexer plate 44 by the sequentially operated motor 88 in order to present a vial 20 to the user ready for pickup. The relationship and interaction of the solenoid 104 and the indexer orifices 72*a*–72*v* about the indexer plate 44 forms a locking arrangement to prevent the rotation of the indexer plate 44 in order to retrieve medications illegally or ahead of schedule. The solenoid 104 is normally in the unactuated position, whereas the solenoid actuator shaft 106 is normally in the extended position by internal solenoid spring action through one of the indexer orifices 72*a*–72*v* in the indexer plate 44, thereby preventing the manual rotation of indexer plate 44 until programmed Meds times occur. In the event of power interruption, the solenoid actuator shaft 106 remains engaged with the indexer orifices 72*a*–72*v* to prevent manual advancement of the indexer plate 44 in order to retrieve medications illegally or ahead of schedule. During actuation of the solenoid 104, the motor 88 is energized to advance the indexer plate 44 one position to deliver the Meds into the Meds delivery port 40. Rotation of the indexer plate 44 by the motor 88 is controlled by the sensing of the next advancing indexer orifice of the indexer orifices 72*a*–72*v* by the optical sensor switch 98. When the oncoming indexer orifice is sensed by the optical sensor switch 98, power to the motor 88 is interrupted, thereby ceasing rotation of the indexer plate 44 to deliver the scheduled Meds at the Meds delivery port 40. Such power interruption also removes power to the solenoid 104, thereby allowing the solenoid actuator shaft 106 to engage the appropriate indexer orifice of the indexer orifices 72*a*–72*v*. Upon such advancement of the indexer plate 44, the appropriate green verification light located on the control panel 42 above the MED 1 button, the MED 2 button, or the MED 3 button becomes illuminated each time a programmed Meds time occurs with the delivery of Meds. These verification lights provide assurance and let the user identify and verify which Meds time has occurred. Once the vial 20 containing the Meds has been removed from the automated Meds dispenser 12, the user presses and resets the appropriate MED 1, MED 2 or MED 3 button and the appropriate green verification light is extinguished to await the next scheduled Meds time where the delivery sequence is repeated.

In addition to the green verification lights, the audible warning device 112 emits a pulsed audible tone when Meds times occur. Both the applicable green verification light and the audible sound remain active until the appropriate MED 1, MED 2 or MED 3 button below the green flashing verification light is pressed for reset of the green verification light and the audible warning device 112 subsequent to Meds pickup by the user. This resetting action will confirm to family members or administrators that medicines were received by the patient.

Should the main power accidentally be shut off, the backup battery 120 continues the operation of the clock in the microprocessor 114. When the main power is restored, the automated Meds dispenser 12 will begin delivering medication when the next programmed time occurs. It will not become confused and deliver improper Meds at the wrong time. In the unlikely event that the automated Meds dispenser 12 breaks down or fails to operate for any reason, the Meds can be retrieved by simply removing screw fasteners 52 in the base 28 and disengaging the cover 26 from the base 28 and by then removing the vials 20 from the indexer plate 44 where they are held in place.

An individual can interrupt an ongoing scheduled Meds delivery cycle by turning the key to position the multiple position key switch 110 to the INT position in order to add or delete Meds to or from any vial 20 and then return to the previous position without interruption to the scheduled cycle. The microprocessor 114 remembers the previous position of the indexer plate 44 and cycles the indexer plate 44 back to the previous position subsequent to addition or deletion of Meds from the vials 20 when the key of the multiple position key switch 110 is positioned to the RUN position.

An individual can also load or reload the automated Meds dispenser any time of day or night, any day of the week, and rest assured that it will begin a new 7-day cycle at the next scheduled Meds time. Turning the key to position the multiple position key switch 110 to the LOAD position causes the motor 88 to revolve the indexer plate 44 until the indexer orifice 74 is sensed by the optical sensor switch 100, thereby removing power from the motor 88 and returning the indexer plate 44 to the HOME position for reloading, such as by turning the key to position the multiple position key switch 110 to the LOAD position and then following steps 7, 8 and 9 repeatedly until all loading is accomplished, followed by turning the key to position the multiple position key switch 110 to the RUN position.

Various modifications can be made to the present invention without departing from the apparent scope thereof.

It is claimed:

1. An automated Meds dispenser for systematic sequential dispensing of vials containing Meds at predetermined times, the automated Meds dispenser comprising:

a. a base;

b. a cover, attachable to the base, the cover including:
   (1) a delivery port;
   (2) a control panel; and,
   (3) a power supply jack;

c. a rotatable indexer plate, carried by the base within the cover, the rotatable indexer plate including:
   (1) a plurality of vial orifices distributed sequentially and spaced equally near the periphery of the rotatable indexer plate in a circular path, the vial orifices sequentially opening to the delivery port, with an area between two of the plurality of vial orifices lacking a vial orifice and defining a HOME position; and,
   (2) a plurality of indexer orifices distributed sequentially and spaced equally around the rotatable indexer plate in a circular path of smaller radius than the radius of the circular path of the plurality of vial orifices, there being an indexer orifice corresponding to each one of the plurality of vial orifices;

d. a drive motor for rotating the rotatable indexer plate;

e. an optical sensor switch for sensing alignment therewith of an indexer orifice of the plurality of indexer orifices;

f. a solenoid including an actuator shaft arranged to normally engage an indexer orifice of the plurality of indexer orifices and thereby to inhibit rotation of the rotatable indexer plate; and, g. a programmable computer, including a clock, for detecting occurrence of a predetermined time and then instructing the solenoid actuator shaft to disengage, subsequently instructing the drive motor to rotate the rotatable indexer plate until the next sequential indexer orifice of the plurality of indexer orifices is sensed, then discontinue instructing the drive motor to rotate and discontinue instructing the solenoid actuator shaft to disengage, such that a sequential vial orifice is coordinated with the delivery port and any vial of Meds present in the sequential vial orifice is dispensed.

2. The automated Meds dispenser of claim 1, wherein the Meds dispenser is loaded with a plurality of sequentially ordered vials containing predetermined Meds, each of the plurality of sequentially ordered vials to be dispensed at a predetermined time.

3. The automated Meds dispenser of claim 1, further comprising a backup battery for the clock.

4. The automated Meds dispenser of claim 1, further comprising a switch to allow the programmable computer to be programmed.

5. The automated Meds dispenser of claim 1, further comprising a switch to allow the clock to be set to correct time.

6. The automated Meds dispenser of claim 1, further comprising a switch to allow the vial orifices of the automated Meds dispenser to be loaded with sequentially ordered Meds vials.

7. The automated Meds dispenser of claim 1, further comprising a multi-position switch to allow the programmable computer to be programmed, to allow the clock to be set to correct time, to allow the vial orifices of the automated Meds dispenser to be loaded with sequentially ordered Meds vials, and to allow the automated Meds dispenser to run the computer program to dispense sequentially ordered Meds vials.

8. The automated Meds dispenser of claim 7, wherein the multi-position switch is a key switch to limit switching to key holders.

9. The automated Meds dispenser of claim 1, wherein the control panel includes visual alerts.

10. The automated Meds dispenser of claim 9, wherein the visual alerts occur when a predetermined dispensing time is recognized.

11. The automated Meds dispenser of claim 10, wherein the control panel includes a reset switch to confirm recognition of the visual alerts and to stop each visual alert occurrence from continuing.

12. The automated Meds dispenser of claim 1, wherein an audible alert occurs when a predetermined time is recognized.

13. The automated Meds dispenser of claim 1, wherein both an audible alert and a visual alert occur when a predetermined time is recognized.

14. The automated Meds dispenser of claim 1, further comprising:

a. an additional indexer orifice on the rotatable indexer plate, the additional indexer orifice lying on a circular path distinct from the circular path of the plurality of indexer orifices, the additional indexer orifice defining a HOME indexer orifice having a coordinated relationship with the area defining a HOME position; and, b. another optical sensor switch for sensing alignment therewith of the HOME indexer orifice to thereby allow the programmable computer to identify coordination of the area defining a HOME position with the delivery port to facilitate sequential dispensing.

* * * * *